US011439235B2

(12) United States Patent
Taylor, II et al.

(10) Patent No.: US 11,439,235 B2
(45) Date of Patent: Sep. 13, 2022

(54) SEAT TILTING SYSTEM

(71) Applicant: Artco-Bell Corporation, Temple, TX (US)

(72) Inventors: Kenneth W. Taylor, II, Belton, TX (US); Mark E. Stenftenagel, Elmhurst, IL (US); Richard K. Joutras, Oak Brook, IL (US)

(73) Assignee: Artco-Bell Corporation, Temple, TX (US)

( * ) Notice: Subject to any disclaimer, the term of this patent is extended or adjusted under 35 U.S.C. 154(b) by 0 days.

(21) Appl. No.: 17/072,852

(22) Filed: Oct. 16, 2020

(65) Prior Publication Data

US 2022/0117396 A1 Apr. 21, 2022

(51) Int. Cl.
*A47C 1/032* (2006.01)
*A47C 7/14* (2006.01)

(52) U.S. Cl.
CPC ..... *A47C 1/03288* (2013.01); *A47C 7/14* (2013.01)

(58) Field of Classification Search
CPC ..... A47C 3/0252; A47C 3/026; A47C 7/14; A47C 1/03288; A47C 7/44; A47C 7/448; A47C 1/03261
USPC ..... 297/344.19, 258.1, 270.1, 270.2
See application file for complete search history.

(56) References Cited

U.S. PATENT DOCUMENTS 3,052,435 A * 9/1962 Roller ..... F16F 3/10 248/569
3,259,431 A * 7/1966 Gale ..... A47C 3/12 297/303.1
5,044,587 A * 9/1991 Degen ..... A47C 3/0252 248/158
5,769,492 A * 6/1998 Jensen ..... A47C 9/002 297/188.09
7,100,983 B1 * 9/2006 Gant ..... A47C 3/025 297/314
8,439,442 B2 * 5/2013 Highlander ..... A47C 7/14 297/313
8,888,184 B2 * 11/2014 Meyer ..... A47C 1/03255 297/302.1
9,107,505 B1 * 8/2015 Ma ..... A47C 7/029
9,839,296 B2 * 12/2017 Ballendat ..... A47C 7/004
10,034,547 B1 * 7/2018 Pan ..... A47C 3/0252
11,103,072 B2 * 8/2021 Rheault ..... A47C 9/007

FOREIGN PATENT DOCUMENTS

DE 102014000386 A1 * 7/2015 ..... A47C 7/14

* cited by examiner

*Primary Examiner* — Milton Nelson, Jr.
(74) *Attorney, Agent, or Firm* — K&L Gates LLP

(57) ABSTRACT

A seat tilting device includes: a bottom plate secured to a seat base; a top plate secured to a seat; a pivot connecting the top plate to the bottom plate; a compression spring surrounding the pivot; and a compression ring surrounding the compression spring, wherein there is space between a bottom surface of the top plate and a top surface of the compression ring such that the top plate may tilt on the pivot until it contacts the top surface of the compression ring and the movement of the top plate is resisted by the compression spring.

19 Claims, 8 Drawing Sheets

SEAT TILTING SYSTEM

BACKGROUND OF THE INVENTION

The present subject matter relates generally to a mechanism for providing and controlling a tilting motion is a seat such as a desk chair. More specifically, the present subject matter provides a unique pivoting structure that provides a limited range of vertical axis tilt that is unconstrained in direction about a horizontal plane.

Sitting in one position on a chair for hours at a time, as many people do in both work and education contexts, can be uncomfortable. In some situations, our chairs can contribute to health problems relating to users being confined to a limited range of positions for a prolonged time period. For example, many employees have desk jobs where they essentially work from a chair for the day. Because conventional chairs restrict movement of a user in a limited range, a user may remain in a single position for hours at a time, which can be both uncomfortable and, in extreme situations, may contribute to the development or advancement of orthopedic problems.

To address these concerns, chairs have been developed to allow limited movement to engage back musculature and vertebral discs. For example, conventional office chairs can include a tilting mechanism to enable a user to tilt forward and backwards about a pivot axis perpendicular to the seat base of the chair. Typically, such chairs include a resistance and bias wherein the seat automatically returns to its upright position after tilting to a reclining position. Such mechanisms include coils and sprints to oppose the tilting motion.

Such conventional tilting mechanisms often limit tilting to a single, fixed vertical plane bisecting the chair from front to back, thus restricting the tilting movement of the user to a forward and rearward rocking/tiling motion. These conventional tilting mechanisms do not allow the user to tilt the seat in other directions, such as to the sides or other angles that are off the single vertical plane.

Further, conventional tilting chairs often include a complicated and complex tilting mechanism, which makes stacking the chairs essentially impossible. Moreover, most conventional chairs capable of tilting include a central support beam extending vertically from a bottom surface of a seat portion of the chair. As a result of the central support beam, the conventional chairs cannot be stacked or stored efficiently.

Accordingly, there is a need for a tilting mechanism that enables tilting in a wider range of directions and can be used in a manner that provides for efficient stacking and storing of the chairs.

BRIEF SUMMARY OF THE INVENTION

The present disclosure provides a tilting system for chairs. Various examples of the systems are provided herein.

The present tilting system includes a tilting assembly that is integrated into a seat portion of a chair. A primary embodiment of the tilting assembly includes an annular elastomer compression spring positioned between two plates, a top plate and a bottom plate, and retained in place by a circular compression ring, a rigid vertical wall that surrounds the compression spring. Further, the compression spring surrounds a pivot, referred to herein as the kingpin, that provides the pivot point between the top plate and the bottom plate.

The elastomer compression spring is retained in place between the two plates by the circular compression ring. The compression ring does not actively compress the elastomer compression spring, but rather the compression ring constrains the elastomer compression spring from moving laterally, thereby constraining the position of the elastomer compression spring and improving its resistance to vertical compression by limiting the elastomer compression spring from excess lateral deformation.

In this primary embodiment, the top plate is connected to the bottom surface of a seat and the bottom plate is connected to a top surface of a base (e.g., the legs or similar support structure of the chair). Relative to the base, the bottom plate remains in a fixed position while the top plate and the connected seat pivot about a vertical axis in response to movement of the seated person.

The height of the compression ring (i.e., the rigid wall surrounding the compression spring) acts as a positive stop for the tilting motion of the top plate, thereby preventing the seat bracket from tilting too far in any direction.

By providing a pivot point (e.g., the kingpin) about which a seated user can pivot the seat connected to the top plate away from the vertical axis in any direction around a horizontal plane (e.g., the bottom plate), the present subject matter provides a simple, but very useful tilting mechanism that can be implemented in a wide range of chairs.

The parameters of the tilting mechanism can be easily adjusted by altering the structure and composition of the components in the system. For example, varying the compression spring's resistance to compression will vary the force required to tilt the seat. Raising or lowering the height of the compression ring, thereby creating a larger or narrower distance between the top plate and the top surface of the compression ring, will vary the angle to which the seat can tilt. Providing more or less room for the compression spring to expand horizontally into, or against, the compression ring can vary the sensation the user experiences when sitting down on or standing up from the seat.

The chair may further include a seat back attached to the bottom plate, wherein the seat back includes a series of ribs along a rear surface and lower surface of the seat back such that a first surface shape formed by the ribs matches a second surface shape formed by a top surface of the seat and a front surface of the seat back.

In a primary embodiment, a seat tilting device includes: a bottom plate secured to a seat base; a top plate secured to a seat; a pivot connecting the top plate to the bottom plate; a compression spring surrounding the pivot; and a compression ring surrounding the compression spring, wherein there is space between a bottom surface of the top plate and a top surface of the compression ring such that the top plate may tilt on the pivot until it contacts the top surface of the compression ring and the movement of the top plate is resisted by the compression spring.

The compression spring may be an annular compression spring. The compression ring may be an annular compression ring. The pivot may include a bolt that passes through the bottom plate and attaches to the top plate. The bolt may attach to a weld nut attached to the top plate. The pivot may further include one or more washers through which the bolt passes. The compression spring may include a viscoelastic polymer. The compression spring may be a uniform material. The compression spring may be a unitary element. The compression spring may include two or more ends joined to each other.

The seat tilting device may further include an extension spring connecting the top plate to the bottom plate biasing rotation of the top plate in relation to the bottom plate towards a first position. The top plate may pivot on the pivot in a 360-degree range. The top plate may rotate on the pivot.

The seat tilting device may further include a seat back attached to the bottom plate. The seat back may include a series of ribs along a rear surface and lower surface of the seat back such that a first surface shape formed by the ribs matches a second surface shape formed by a top surface of the seat and a front surface of the seat back.

In another embodiment a chair includes: a bottom plate secured to a seat base; a top plate secured to a seat; a pivot connecting the top plate to the bottom plate, wherein the pivot includes a bolt passing through the bottom plate and connecting to a weld nut attached to the top plate, wherein the top plate pivots on the pivot in a 360-degree range; an annular, uniform, elastomeric compression spring surrounding the pivot; and an annular compression ring surrounding the compression spring, wherein there is space between a bottom surface of the top plate and a top surface of the compression ring such that the top plate may tilt on the pivot until it contacts the top surface of the compression ring and the movement of the top plate is resisted by the compression spring. The chair may further include an extension spring connecting the top plate to the bottom plate biasing rotation of the top plate in relation to the bottom plate towards a first position. The chair may further include a seat back attached to the bottom plate, wherein the seat back includes a series of ribs along a rear surface and lower surface of the seat back such that a first surface shape formed by the ribs matches a second surface shape formed by a top surface of the seat and a front surface of the seat back.

A primary advantage of the seat tilting system provided herein is the doughnut-shaped compression spring that is constrained between the top plate and bottom plate by the compression ring provides a smooth and natural feeling tilting motion along all 360 degrees around the axis of the pivot.

Another advantage of the seat tilting system is that the doughnut shape of the compression spring allows for a progressive spring rate, which enables the spring rate to adjust to users of different sizes.

Another advantage of the seat tilting system is that enabling tilting of a seat in all directions can help to minimize hip and back health issues that can result from static sitting.

Another advantage of the present system is providing a tilting seat mechanism that can be used across a wide range of chairs, including traditional four-legged chairs, cantilever chairs, gas lift task chairs, gas lift stools, caster chairs, café chairs, rocking chairs, and so on.

A further advantage of the seat tilting system is providing a seat with a tilting mechanism that allows chairs using the seat systems to be stacked easily for storage.

Yet another advantage of the seat tilting system is that it provides a design for structural ribs on the underside of the chair back and seat that are contoured to match up with the topside contour of the seat to provide for a more stable and consistent stack of chairs.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
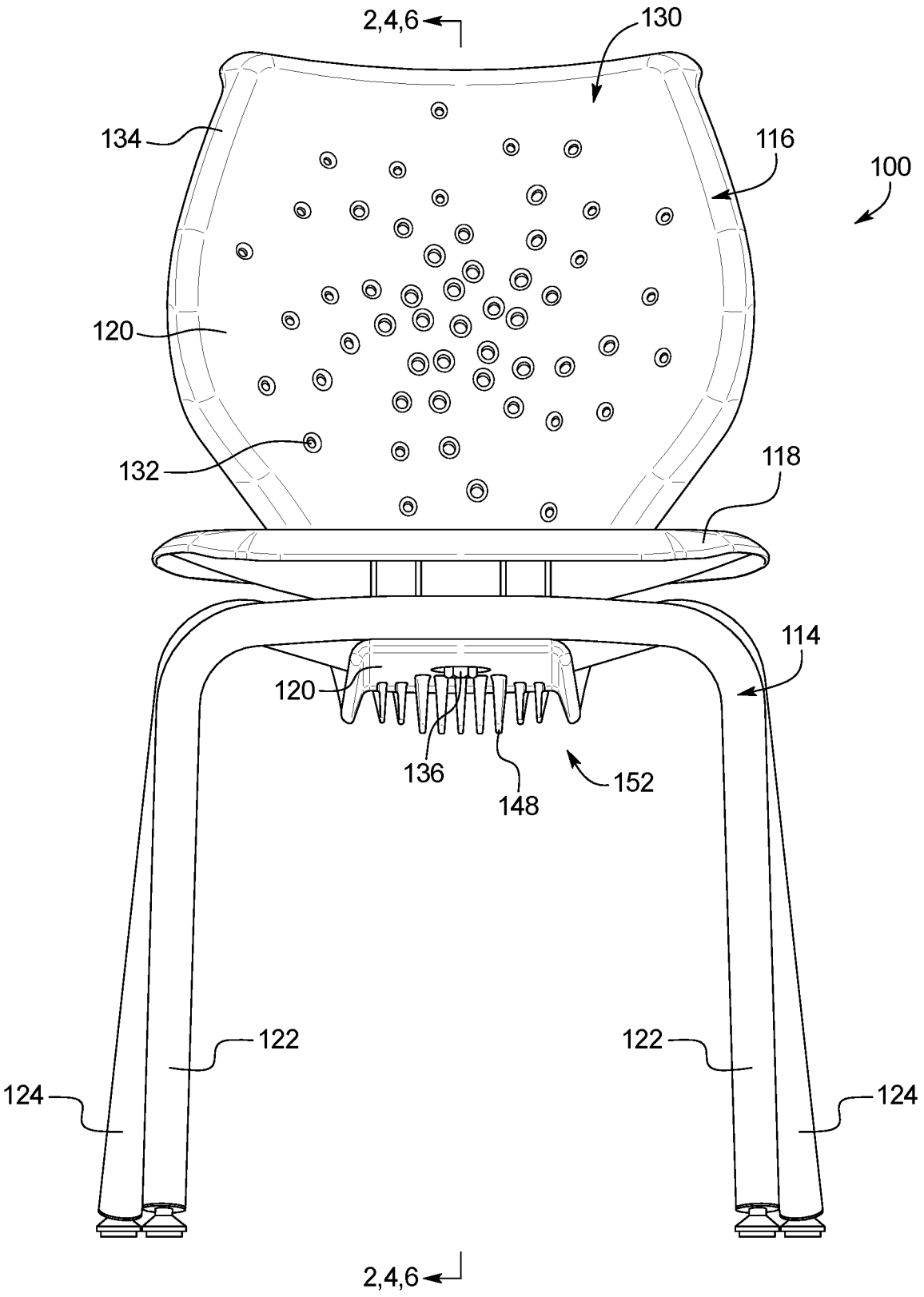
FIG. 1 is a front side view of an example of chair incorporating the seat tilting system providing here.

The present subject matter provides a seat system 100 including a tilting mechanism that enables users to tilt the seat in which they are sitting in any direction around a vertical pivot point. The seat system 100 can be embodied in a wide range of applications, which will be understood by those skilled in the art based on the teachings provided by this disclosure.

The core elements of the seat system 100 include a pivot 102, a compression spring 104, a compression ring 106, a bottom plate 108 (e.g., the chair base plate 108), and a top plate 110 (e.g., the seat bracket 110). These elements are the basis of the seat tilting system 112, which, in cooperation with a seat base 114 and a seat body 116 form the seat system 100.

In the example shown in FIG. 1, the seat system 100 includes a seat body 116 having a roughly "L" shape on top of a four-legged seat base 114. However, the seat tilting system 112 can be used with a wide range of seat bases 114 and seat bodies 116, not just the examples shown in FIGS. 1-8. For example, the seat tilting system 112 can be used in traditional four-legged chairs, cantilever chairs, gas lift task chairs, gas lift stools, caster chairs, café chairs, rocking chairs, etc.

Figure 2:
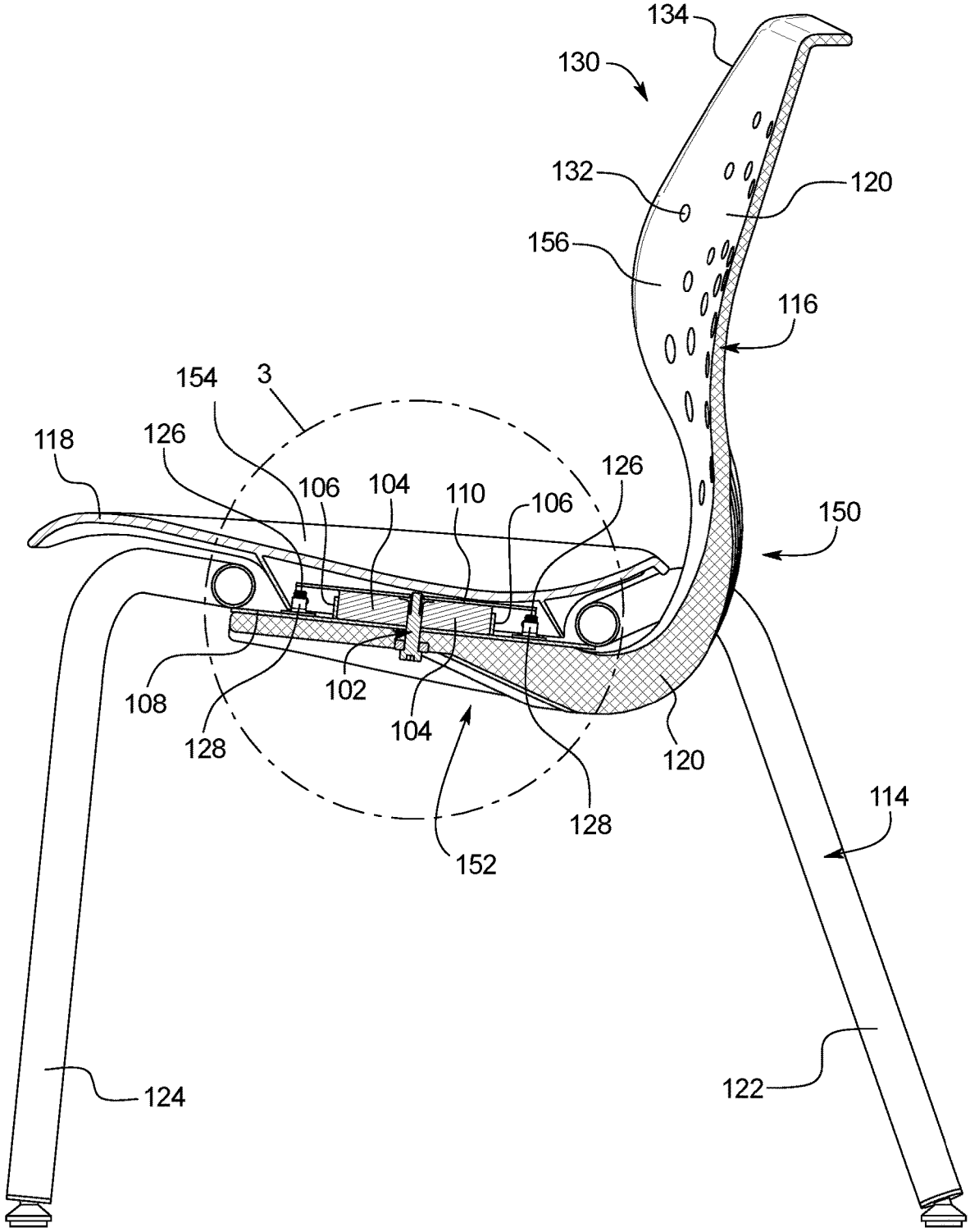
FIG. 2 is a first example of a cross-sectional side view of an example of the chair shown in FIG. 1 (Section 2-2).
Figure 3:
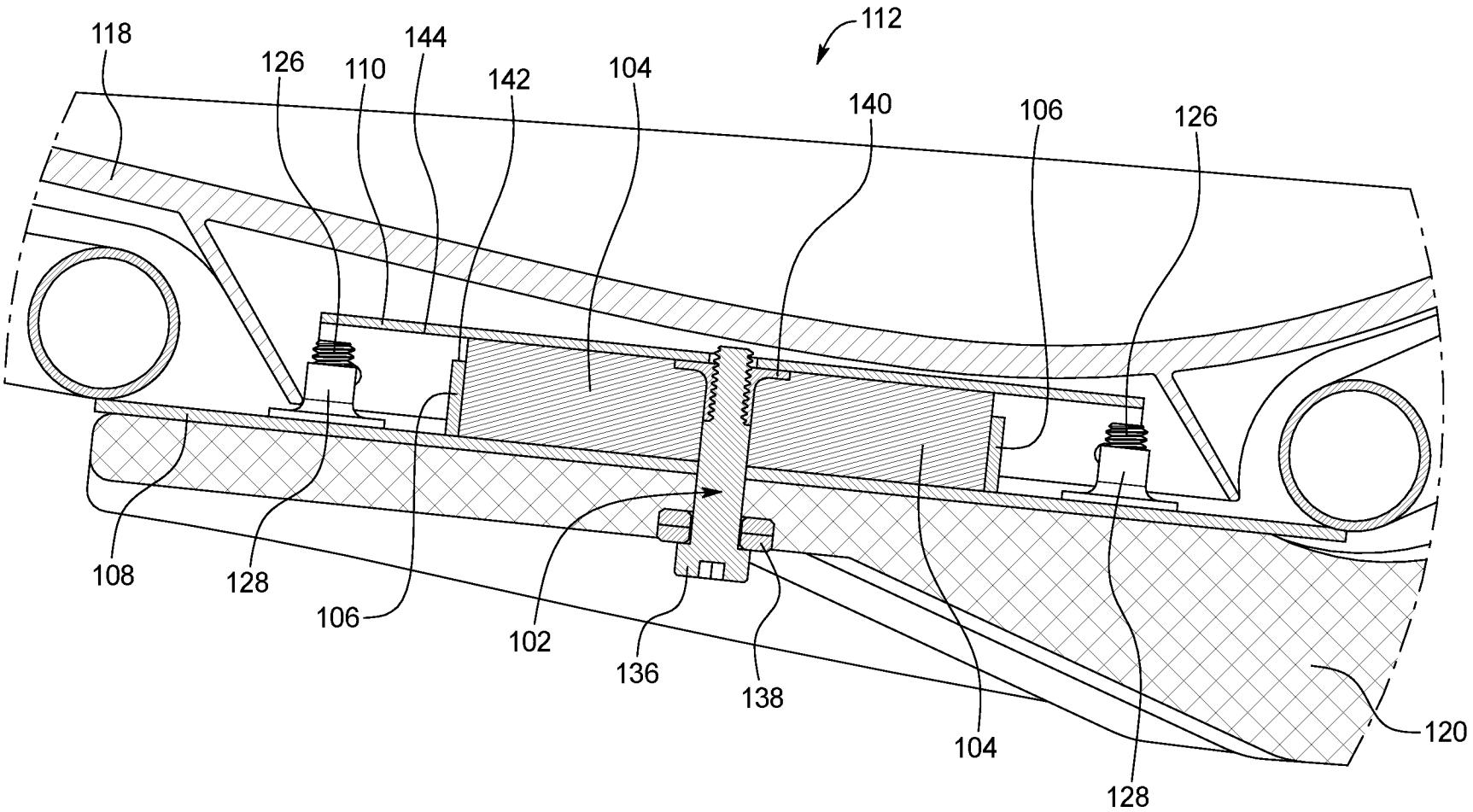
FIG. 3 is a detail view of an example of a first example of the seat tilting system shown in FIG. 2 (Detail 3).
Figure 4:
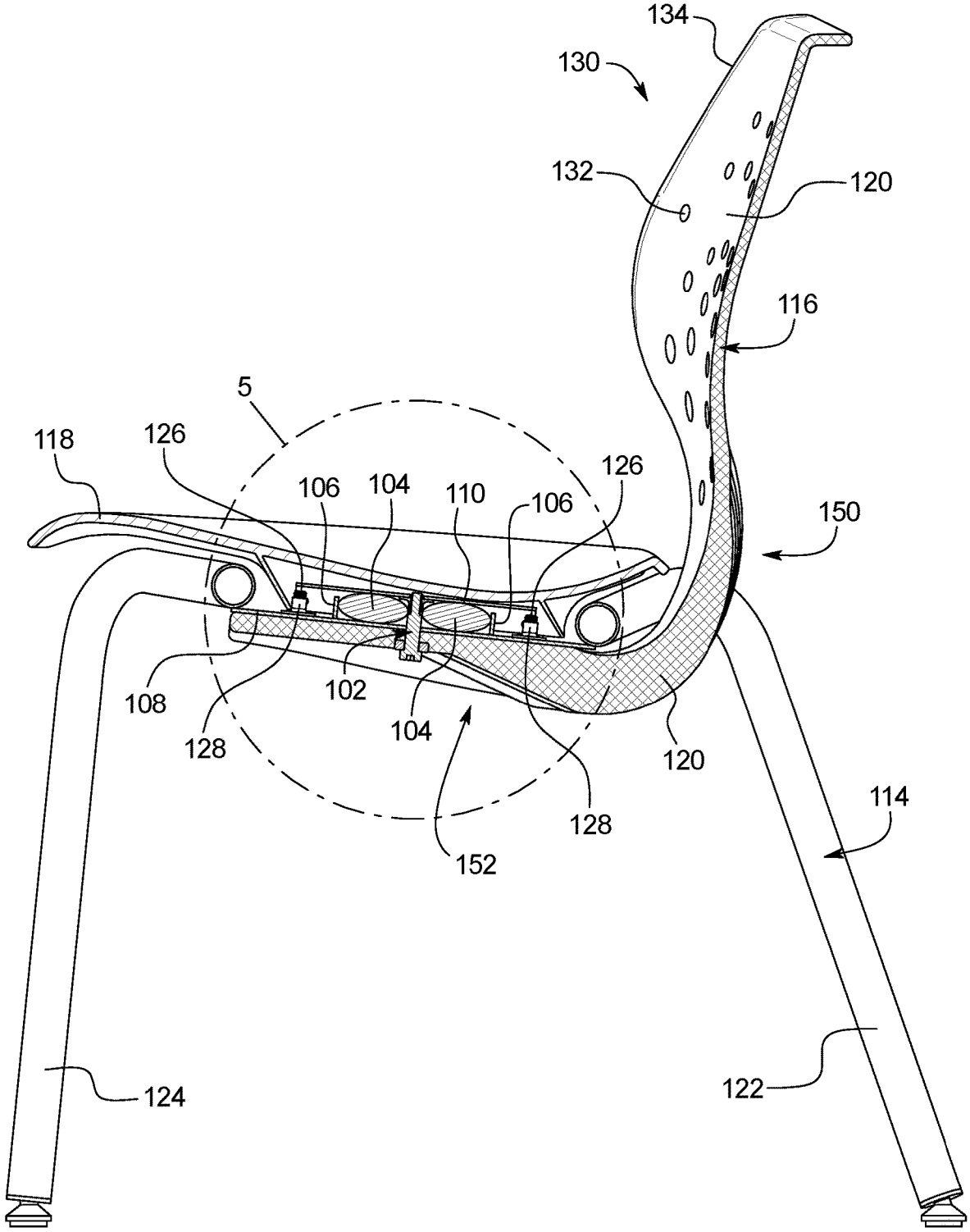
FIG. 4 is a second example of a cross-sectional side view of the example of the chair shown in FIG. 1 (Section 4-4).
Figure 5:
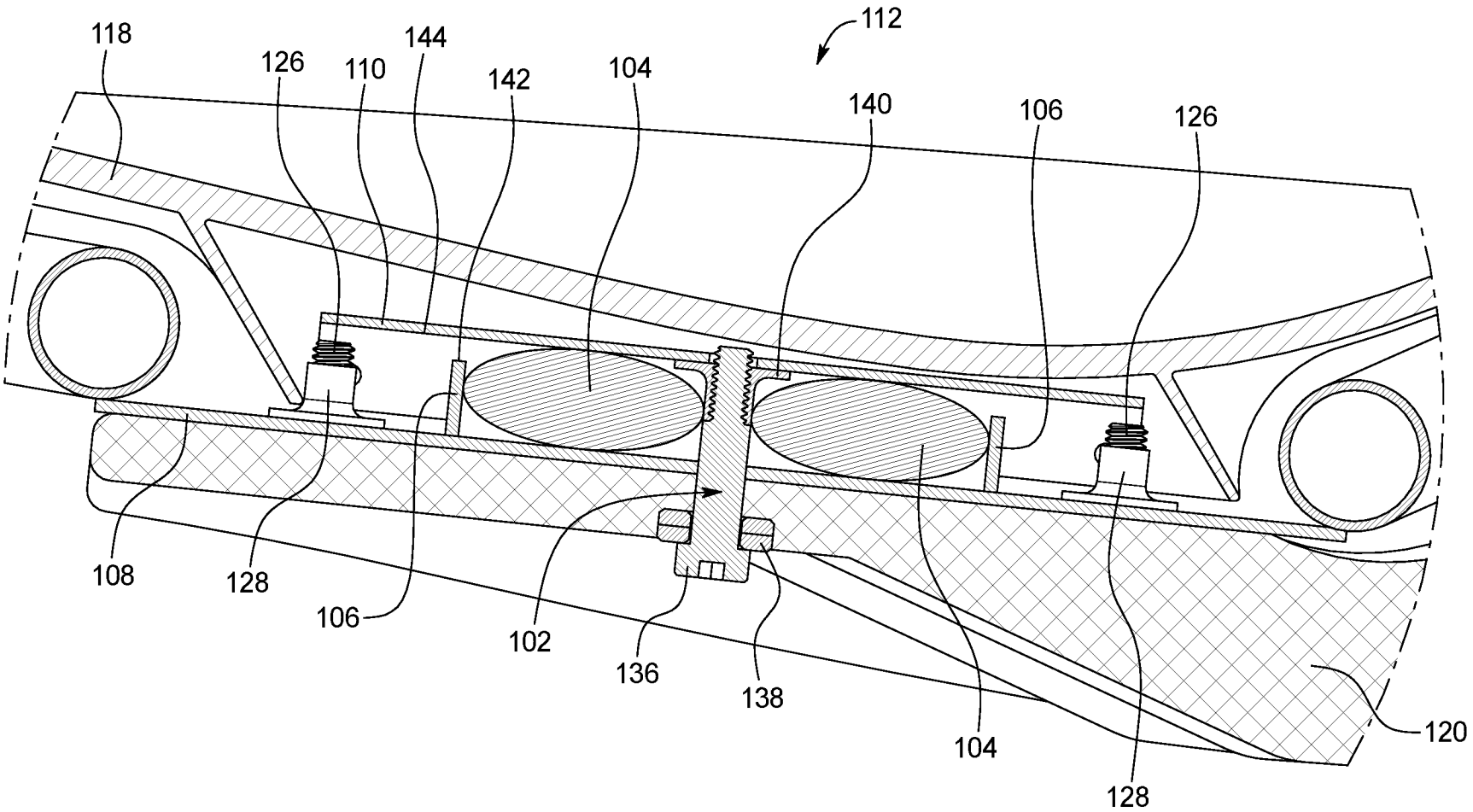
FIG. 5 is a detail view of an example of the second example of the seat tilting system shown in FIG. 4 (Detail 5).

FIGS. 2 and 3 illustrates a cross-sectional side view of a first example of a seat system 100 that embodies the teachings of the present disclosure. As shown in FIGS. 2 and 3, the seat tilting system 112 sits at the interface between the seat base 114 and the seat body 116, providing a pivoting and rotating seat 118 as described more fully herein. In the specific example shown, the seat body 116 includes a seat 118 and a seat back 120. In this example, both the seat base 114 and the seat back 120 attach to the bottom plate 108 and the seat 118 attaches to the top plate 110. Accordingly, the seat 118 and the seat back 120 move relative to each other. In other examples, the entire seat body 116 structure (e.g., seat 118 and seat back 120) may attach to the top plate 110 and the seat base 114 may attach to the bottom plate 108.

In the example shown in FIGS. 1-8, the seat base 114 includes a pair of back legs 122 and a pair of front legs 124 connected to form a four-legged structure. The legs 122 and 124 connect to the bottom plate 108, which is further connected to the seat back 120. In the examples shown in FIGS. 2-7, the bottom plate 108 is bolted to the seat back 120 using attachment bolts 126 and weld nuts 128. Other attachments mechanisms may be used, as will be recognized by those skilled in the art based on the descriptions provided herein.

As shown in FIGS. 1, 2, 4, 6, and 8, the seat back 120 includes an upper back portion 130 for a user to rest his or her back against while sitting. In the examples shown, the upper back portion 130 includes a plurality of openings, ridges, and textures, among others. For example, the upper back portion 130 includes a perforated pattern 132 radially extending from its center towards its edges. Similarly, the upper back portion 130 shown is surrounded by a rim 134 along its perimeter. These aesthetic design elements are just one example of a chair that may incorporate the teachings provided herein. For example, based on the teachings provided herein, it will be easily understood by those skilled in the art that the chair may include arm rests, though none are shown in FIGS. 1-8.

Turning now to FIG. 3, the elements of the seat tilting system 112 are shown in more detail. The pivot 102 is the element about which the bottom plate 108 and the top plate 110 pivot with respect to each other. As shown in FIG. 1, the pivot 102 includes a kingpin 136 bolted through the seat back 120 and the bottom plate 108, through a set of misalignment washers 138 and secured to the top plate 110 via a weld nut 140. The key function of the pivot 102 is to connect the bottom plate 108 to the top plate 110 in a manner such that they may pivot with respect to each other. In the embodiment shown in FIG. 3, not only can the top plate 110 pivot around the pivot 102 in a 360-degree range, it may also swivel around the pivot 102.

As further shown in the embodiment shown in FIG. 3, the annular compression spring 104 surrounds the pivot 102, specifically the kingpin 136 element, and occupies the space inside and abuts the inner circumference of the annular compression ring 106. Accordingly, the compression spring 104 is located inside the space formed by the bottom plate 108, the top plate 110, and the compression ring 106.

In a primary embodiment, the compression spring 104 is formed from a flexible, elastomeric material. In such an embodiment, the compression spring 104 may be formed from any suitable polymer with viscoelasticity. The compression spring 104 can be thermoset, thermoplastic, or combinations thereof. The compression spring 104 can be naturally occurring, synthetic, or combinations thereof. The compression spring 104 can include rubber, neoprene rubber, buna-s, buna-n, polybutadiene, styrene-butadiene, nitrile rubber, ethylene propylene rubber, silicone rubber, polyacrylic rubber, ethylene-vinyl acetate, polysulfide rubber, among others, and combinations thereof.

As shown in FIG. 3, the compression ring 106 surrounds the compression spring 104. In doing so, the compression ring 106 retains the compression spring 104 in place and prevents it from deforming outwardly when pressure is put on the top plate 110 (i.e., when a person sits on the chair). The compression ring 106 may not actually compress the compression spring 108 and may merely constrain the compression spring 108 from moving laterally, thereby maintaining the position of the compression spring 108 and improving its resistance to vertical compression (e.g., by preventing the compression spring 108 from deforming laterally).

The compression ring 106 includes an upper annular surface 142 that is lower than a bottom surface 144 of the top plate 110 thereby forming a gap between the bottom surface 144 of the top plate 110 and the upper annular surface 142 of the compression ring 106. The compression spring 108 contacts the bottom surface 144 of the top plate 110. Accordingly, when the top plate 110 pivots on the pivot 102, the compression spring 108 provides resistance to the movement and the upper annular surface 142 of the compression ring 106 provides a positive stop that restricts the range of motion the top plate 110 may tilt in any given direction. The diameter of the compression ring 106 and the distance of the gap between the upper annular surface 142 of the compression ring 106 and the bottom surface 144 of the top plate 110 are variables that can be adjusted to alter the range of motion of the tilting mechanics provided by the seat tilting system 110. For example, the height and position of the compression ring 106 can influence the amount of tilt that is allowed. The density of the compression spring 108 influences the "responsiveness" of the seat tilting system 112. For example, the softer the compression spring 108, the easier it is to tilt the seat 118.

In use, when the user shifts weight on the seat 118, the top plate 110 moves on the pivot 102. When using a uniform material, the annular shape of the compression spring 108 enables the restoring force in the tilting system 110 to be uniform in a 360-degree range. Alternatively, or in addition to, the compression spring 108 may be formed of one or more materials that provide a variety of elasticities around the compression spring 108 such that different directions of tilt have a different restoring force. For example, the compression spring 108 may be designed to have a greater restoring force in the lateral directions than the front and rear directions, or vice versa. In an example, the compression spring 108 could have a greater restoring force in the diagonal directions than the lateral and/or front and rear directions.

Although shown as an annular ring with a rectangular cross-section in the embodiment shown in FIGS. 2 and 3, it is contemplated that the compression spring 108 can be circular, ovular, conical, rectangular, among other shapes. The cross-section of the compression spring 108 can be any suitable shape including, but not limited to, a circle, an oval, a rectangle, among others. For example, in the embodiment shown in FIGS. 4 and 5, the cross-section of the compression spring 108 is an oval. The compression spring 108 can be one singular, continuous (i.e., unitary) body. Alternatively, the elastomer compression spring 108 can have two or more ends that connect to each other with any suitable connector.

Figure 6:
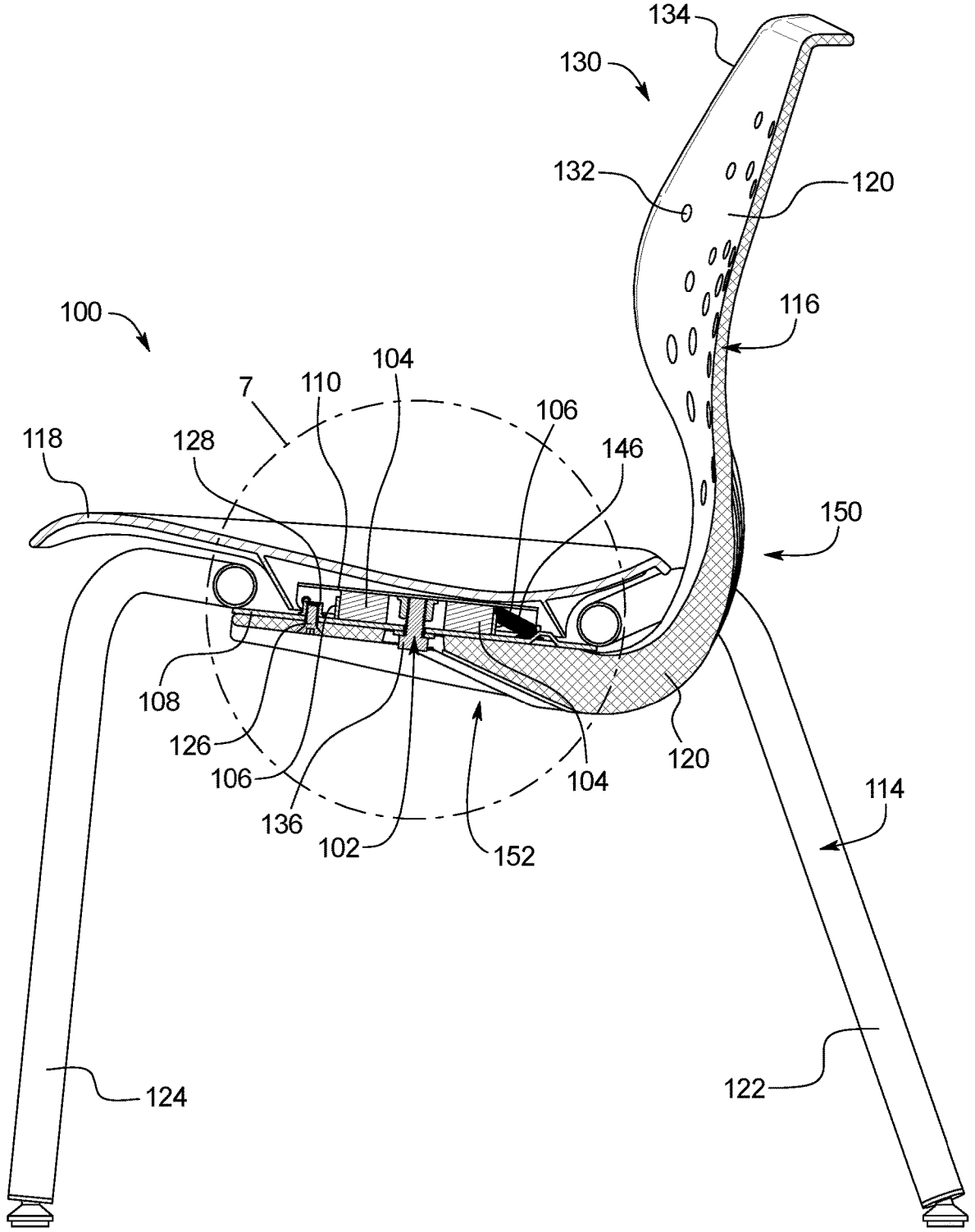
FIG. 6 is a third example of a cross-sectional side view of the example of the chair shown in FIG. 1 (Section 6-6).
Figure 7:
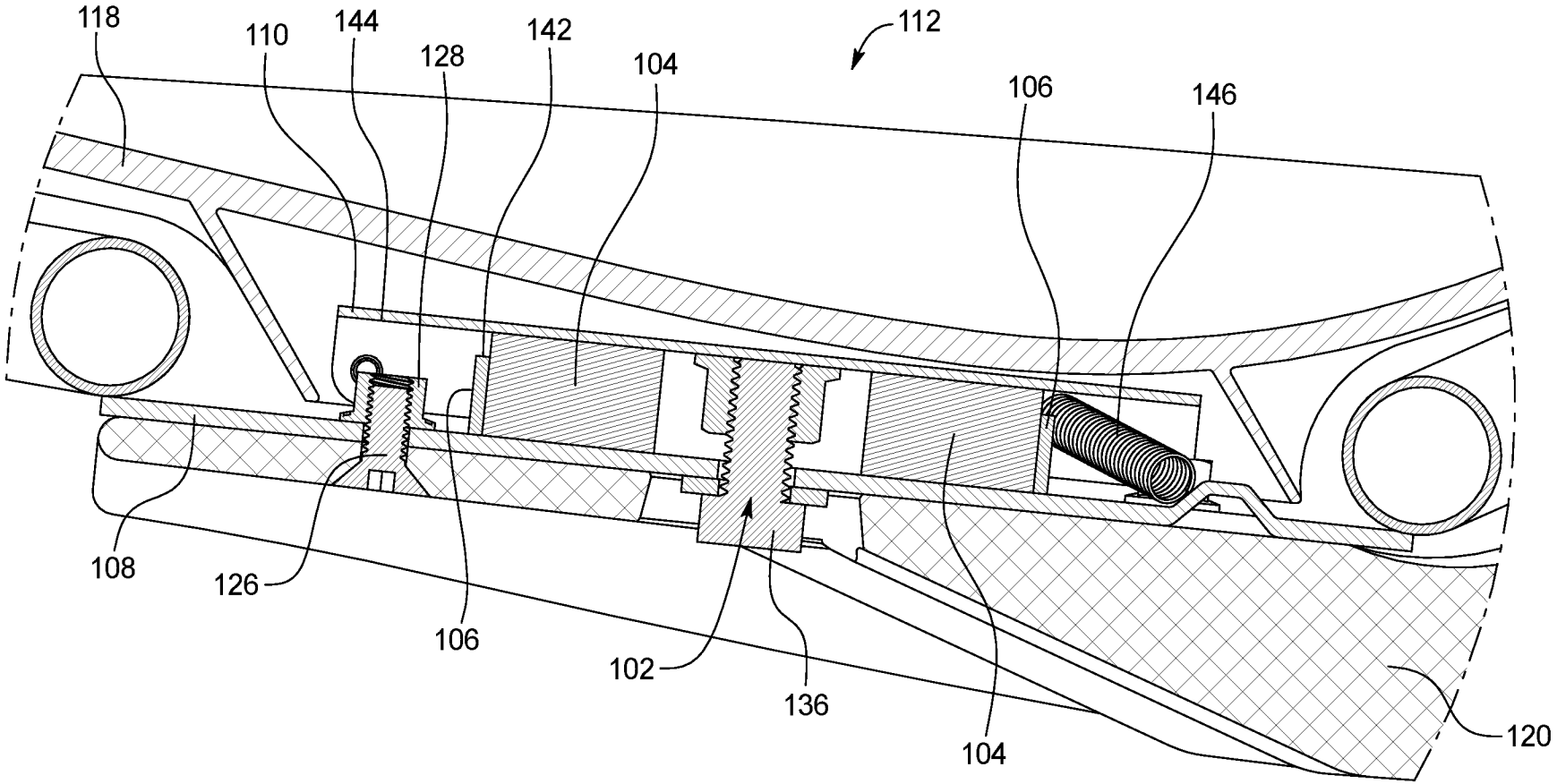
FIG. 7 is a detail view of an example of the third example of the seat tilting system shown in FIG. 6 (Detail 7).

The example of the seat tilting system 112 shown in FIGS. 6 and 7 includes the addition of an optional element, one or more extension springs 146. As noted above, in the example illustrated in FIGS. 2 and 3, the seat 118 freely swivels around the pivot 102. The one or more extension springs 146 provided in FIGS. 6 and 7 help to retain the seat 118 in a centered position as part of an "auto-center" function. In other words, the one or more extension springs 146 are provided to connect between the bottom plate 108 and the top plate 110 and return them to a neutral, centered position when no rotational force is applied to the seat 118.

Unlike conventional tilting chairs, which include a tilting mechanism that extends downward from the center of the seat plate, thereby precluding stacking of the chairs, because the seat tilting system 112 is discretely placed between the seat base 114 and the seat body 116, a plurality of chairs incorporating the seat tilting system 112 can be stacked and compactly stored.

Figure 8:
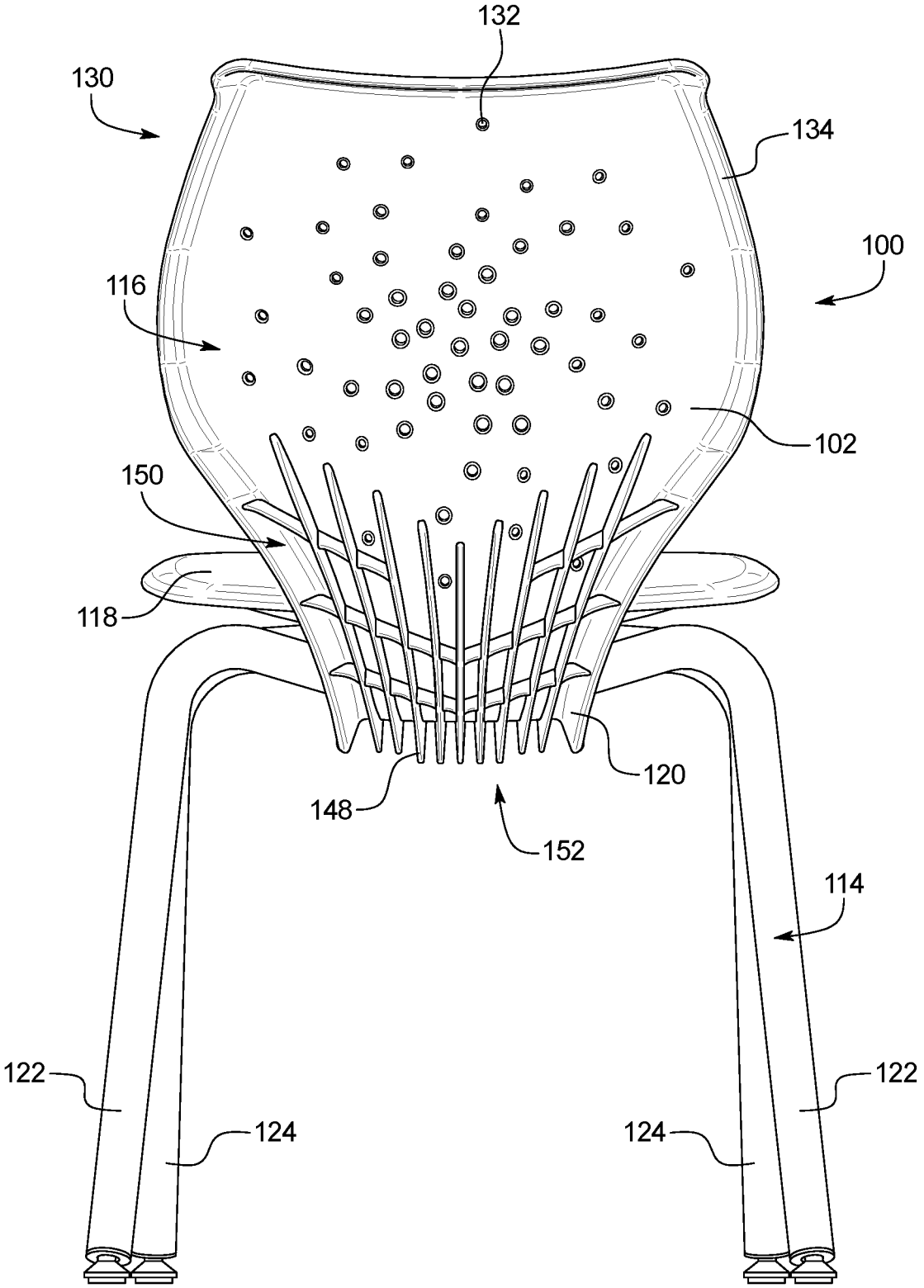
FIG. 8 is a back view of an example of the chair shown in FIG. 1.

In the example shown in FIG. 8, the chair includes a seat back 120 that includes a series of ribs 148 along the rear surface 150 and lower surface 152 of the seat body 116. The ribs 148 are specifically shaped to match the contour of the top surface 154 (see FIG. 2) of the seat 118 and the front surface 156 (see FIG. 2) of the seat back 120. Accordingly, the ribs 148 aid in stacking of the complementary shapes. In a primary example, the ribs 148 run generally linear along the lower surface of the seat body 116 (i.e., parallel and lengthwise) and then fan out radially to the rear surface 150 of the seat back 120. In such an embodiment, the ribs 148 aid in supporting the seat back 120 while also helping to maintain a desired amount of flex and movement in the seat back 120.

It should be noted that various changes and modifications to the embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

We claim:

1. A seat tilting device comprising:

a bottom plate secured to a seat base;

a top plate secured to a seat;

a pivot connecting the top plate to the bottom plate;

a compression spring surrounding the pivot; and a compression ring surrounding the compression spring, wherein there is space between a bottom surface of the top plate and a top surface of the compression ring such that the top plate may tilt on the pivot until it contacts the top surface of the compression ring and the movement of the top plate is resisted by the compression spring.

2. The seat tilting device of claim 1, wherein the compression spring is an annular compression spring.

3. The seat tilting device of claim 2, wherein the compression ring is an annular compression ring.

4. The seat tilting device of claim 1, wherein the pivot includes a bolt that passes through the bottom plate and attaches to the top plate.

5. The seat tilting device of claim 4, wherein the bolt attaches to a weld nut attached to the top plate.

6. The seat tilting device of claim 5, wherein the pivot further includes one or more washers through which the bolt passes.

7. The seat tilting device of claim 1, wherein the compression spring includes a viscoelastic polymer.

8. The seat tilting device of claim 1, wherein the compression spring is a uniform material.

9. The seat tilting device of claim 1, wherein the compression spring is a unitary element.

10. The seat tilting device of claim 1, wherein the compression spring includes two or more ends joined to each other.

11. The seat tilting device of claim 1, further comprising an extension spring connecting the top plate to the bottom plate biasing rotation of the top plate in relation to the bottom plate towards a first position.

12. The seat tilting device of claim 1, wherein the top plate pivots on the pivot in a 360-degree range.

13. The seat tilting device of claim 1, wherein the top plate rotates on the pivot.

14. The seat tilting device of claim 1, further comprising a seat back attached to the bottom plate.

15. The seat tilting device of claim 1, wherein the seat back includes a series of ribs along a rear surface and lower surface of the seat back such that a first surface shape formed by the ribs matches a second surface shape formed by a top surface of the seat and a front surface of the seat back.

16. The seat tilting device of claim 1, wherein the seat base is a four-legged seat base.

17. A chair comprising:

a bottom plate secured to a seat base;

a top plate secured to a seat;

a pivot connecting the top plate to the bottom plate, wherein the pivot includes a bolt passing through the bottom plate and connecting to a weld nut attached to the top plate, wherein the top plate pivots on the pivot in a 360-degree range;

an annular, uniform, elastomeric compression spring surrounding the pivot; and an annular compression ring surrounding the compression spring, wherein there is space between a bottom surface of the top plate and a top surface of the compression ring such that the top plate may tilt on the pivot until it contacts the top surface of the compression ring and the movement of the top plate is resisted by the compression spring.

18. The chair of claim 17, further comprising a seat back attached to the bottom plate, wherein the seat back includes a series of ribs along a rear surface and lower surface of the seat back such that a first surface shape formed by the ribs matches a second surface shape formed by a top surface of the seat and a front surface of the seat back.

19. The chair of claim 17, further comprising an extension spring connecting the top plate to the bottom plate biasing rotation of the top plate in relation to the bottom plate towards a first position.

* * * * *